US008034199B2

(12) United States Patent
Saitoh et al.

(10) Patent No.: US 8,034,199 B2
(45) Date of Patent: Oct. 11, 2011

(54) CASE-HARDENING STEEL EXCELLENT IN COLD FORGEABILITY AND LOW CARBURIZATION DISTORTION PROPERTY

(75) Inventors: Hajime Saitoh, Tokyo (JP); Tatsuro Ochi, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 88 days.

(21) Appl. No.: 11/904,893

(22) Filed: Sep. 27, 2007

(65) Prior Publication Data

US 2009/0087337 A1 Apr. 2, 2009

(51) Int. Cl.
*C22C 38/28* (2006.01)
*C22C 38/32* (2006.01)

(52) U.S. Cl. ..... 148/333; 148/330; 420/121; 420/126; 420/128

(58) Field of Classification Search ..... 148/333–336, 148/330, 320, 319; 420/109, 110, 104, 106, 420/121, 126, 128
See application file for complete search history.

(56) References Cited

FOREIGN PATENT DOCUMENTS

| | | |
|---|---|---|
| JP | 08-333628 | 12/1996 |
| JP | 11-335777 | * 12/1999 |
| JP | 2001-303172 | 10/2001 |
| JP | 2001-329339 | 11/2001 |
| JP | 2002-69573 | * 3/2002 |
| JP | 2005-240175 | 9/2005 |

OTHER PUBLICATIONS

Machine-English translation of Japanese patent 2004-183064, Ochi Tatsuro et al., Jul. 2, 2004.*

Machine-English translation of Japanese patent 11-335777, Ochi Tatsuor et al. Dec. 7, 1999.*

Machine-English translation of Japanese patent 2001-303172, Ochi Tatsuro et al., Oct. 31, 2001.*

* cited by examiner

*Primary Examiner* — Deborah Yee
(74) *Attorney, Agent, or Firm* — Kenyon & Kenyon LLP

(57) ABSTRACT

This invention provides a case-hardening steel excellent in cold forgeability and low carburization distortion property that exhibits low deformation resistance and high limit compressibility when cold, namely, a case-hardening steel excellent in cold forgeability and low carburization distortion property comprising, in mass %, C: 0.07% to 0.3%, Si: 0.01% to 0.15%, Mn: 0.1% to 0.7%, P: 0.03% or less, S: 0.002% to 0.10%, Al: 0.01% to 0.08%, Cr: 0.7% to 1.5%, Ti: 0.01% to 0.15%, B: 0.0005% to 0.005%, N: 0.008% or less, and the balance of Fe and unavoidable impurities, and having a metallographic structure comprising 65% or greater of ferrite and 15% or less of bainite.

7 Claims, 5 Drawing Sheets

CASE-HARDENING STEEL EXCELLENT IN COLD FORGEABILITY AND LOW CARBURIZATION DISTORTION PROPERTY

BACKGROUND OF THE INVENTION

1. Field of the Invention

The present invention relates to a case-hardening steel excellent in cold forgeability and low carburization distortion property.

2. Description of the Related Art

The steels used in gears, shafts, CVJ components and other such machine elements are generally case-hardening steels added with Cr and/or Mo. A machine element is manufactured by first cold-forging and machining the case-hardening steel to a predetermined shape and then carburization-hardening the steel. Cold forging offers good product surface finish and dimensional accuracy and achieves lower production cost and better yield than hot forging. Components conventionally produced by hot forging are therefore more and more being shifted to production by cold forging, so that in recent years the focus on carburized components produced by cold forging/carburization has increased considerably. Owing to this shift from hot forging to cold forging, reduction of steel cold deformation resistance and improvement of steel limit compressibility have become key issues. The former is needed for maintaining forging tool service life and the latter is needed for preventing steel cracking during cold forging.

To this end, Japanese Patent Publication (A) No. 2001-329339, for example, teaches a case-hardening steel for cold forging improved in cold forgeability by controlling C content to the range of 0.1 to 0.4% and controlling the shape of B-system inclusions. And Japanese Patent Publication (A) Nos. H11-335777 and 2001-303172 teach case-hardening steels for cold forging improved in cold forgeability by reducing Si and Mn content in a C content range of 0.1 to 0.3%, adding B to ensure hardenability, and further lowering bainite fraction.

SUMMARY OF THE INVENTION

Although the technologies developed up to now enable cold forging of small size spur gears and other gears of simple configuration, they experience steel cracking when used to cold forge large components and complexly shaped components like helical gears, and remain inadequate regarding limit compressibility during forging. Moreover, in order to respond to the recent rise in calls for automobile noise reduction, it is necessary to reduce the gear noise that is the main cause. In the conventional gears, carburization distortion reduction is insufficient and the present invention is directed to providing a steel that, thanks to low deformation resistance during steel cold forging and markedly better limit compressibility than conventional steel, achieves excellent cold forging performance free of cracking and low distortion after carburization when used to cold forge large components and components of complex shape.

The inventors began their effort to improve the cold formability of case-hardening steel by carrying out various experiments on methods for decreasing deformation resistance. As a result, they learned that reduction of Si and Mn is important for this purpose.

They then sought to find a way to make up for the decrease in hardenability caused by reduction of these elements, without increasing deformation resistance, and discovered that this can be effectively achieved by addition of B and Cr.

Next, they discovered that in some cases increase in limit compressibility cannot necessarily be achieved simply by lowering deformation resistance and learned that increasing ferrite percentage is important.

In addition, they discovered that carburization quenching distortion can be reduced by increasing the ferrite fraction. They accomplished the present invention based on these findings.

The substance of the present invention is as follows.

(1) A case-hardening steel excellent in cold forgeability and low carburization distortion property comprising, in mass %, C: 0.07% to 0.3%,
Si: 0.01% to 0.15%,
Mn: 0.1% to 0.7%,
P: 0.03% or less,
S: 0.002% to 0.10%,
Al: 0.01% to 0.08%,
Cr: 0.7% to 1.5%,
Ti: 0.01% to 0.15%,
B: 0.0005% to 0.005%,
N: 0.008% or less, and the balance of Fe and unavoidable impurities, and having a metallographic structure comprising 65% or greater of ferrite and 15% or less of bainite.

(2) The case-hardening steel excellent in cold forgeability and low carburization distortion property of (1), further comprising, in mass %, one or both of Mo: 0.005% to 0.3% and Ni: 0.1% to 4.5%.

The present invention enables provision of a case-hardening steel that is low in deformation resistance and does not experience cracking during cold forging of complexly shaped components and that exhibits low distortion after carburization quenching, thereby greatly reducing component production cost and greatly improving component shape accuracy.

DESCRIPTION OF THE PREFERRED EMBODIMENT

Figure 1:
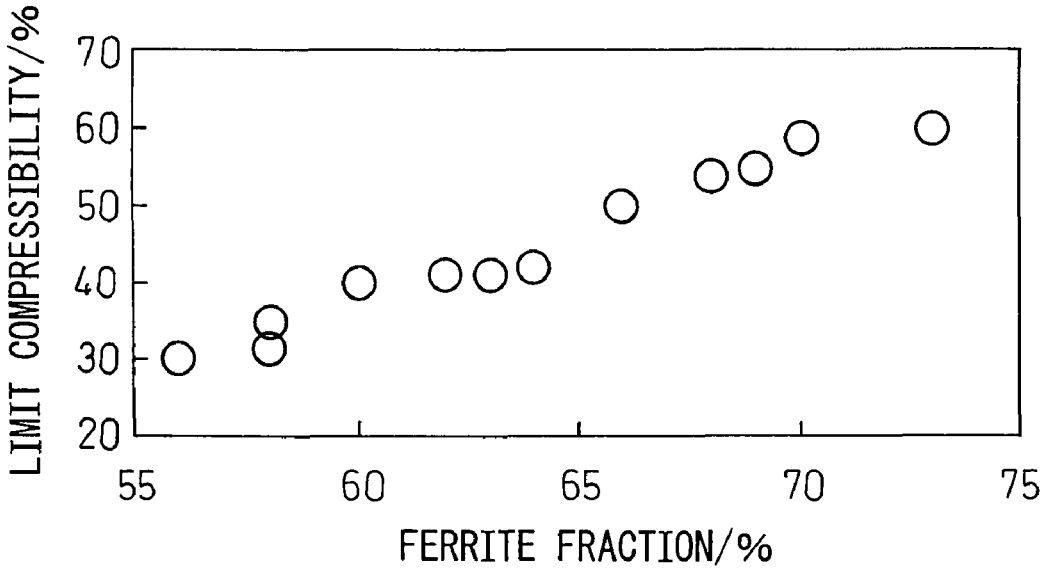
FIG. 1 is a chart showing how limit compressibility varies with ferrite fraction in the metallographic structure of a rolled steel.

The present invention was accomplished based on the foregoing knowledge, and for obtaining a case-hardening steel excellent in cold forgeability and low carburization distortion property, the steel composition requires somewhat low Si and Mn addition at Si: 0.01 to 0.15% and Mn 0.1 to 0.7% for reducing deformation resistance, requires somewhat high Cr addition at Cr: 0.7 to 1.5% for improving hardenability while restraining deformation resistance increase, and requires addition of B: 0.0005 to 0.005% for, inter alia, improving hardenability and increasing ferrite fraction. Moreover, in order to simultaneously achieve limit compressibility improvement and carburization quenching distortion reduction, the cooling rate following hot rolling is controlled to obtain a metallographic structure comprising ferrite phase of 65% or greater and bainite phase of 15% or less.

The invention will now be explained in detail.

C: 0.07 to 0.3%

C is an element effective for imparting required strength to the steel. Required tensile strength cannot be attained at a C content of less than 0.07%, and at a content exceeding 0.3%, the steel hardens to the point of degrading cold forgeability. C content is therefore made 0.07 to 0.3% and preferably 0.07 to 0.25%.

Si: 0.01 to 0.15%

Si is an element effective for deoxidizing the steel. It is also an element effective for imparting required strength and hardenability to the steel, and improving temper softening resistance. These effects are insufficient at an Si content of less than 0.01%. On the other hand, a content exceeding 0.15% increases hardness, thereby degrading cold forgeability. Si content is therefore defined as 0.01 to 0.15%.

Mn: 0.1 to 0.7%

Mn is an element effective for deoxidizing the steel. It is also an element effective for imparting required strength and hardenability to the steel. These effects are insufficient at an Mn content of less than 0.01%. At a content exceeding 0.7%, the effect of Mn saturates and cold forgeability deteriorates owing to increasing hardness. Mn content is therefore defined as 0.1 to 0.07%. The preferred range of Mn content is 0.1 to 0.6%.

P: 0.03% or less

P is an element that increases steel deformation resistance when present in even a small amount and its content should therefore be reduced as much as possible. When P is present in excess of 0.03%, hardness rises to degrade cold forgeability. P content is therefore limited to 0.03% or less.

S: 0.002 to 0.10%

S forms MnS in the steel and is added for the purpose of using MnS to enhance machinability. This effect is insufficient at an S content of less than 0.002%. On the other hand, addition of more than 0.10% increases cracking susceptibility during cold forging and lowers limit compressibility. S content range is therefore prescribed as 0.002 to 0.10%.

Al: 0.01 to 0.08%

Al is added as a deoxidizer. The effect of Al is insufficient at a content of less than 0.01%. When the content exceeds 0.08%, alumina oxide inclusions increase, rasing the probability of their becoming starting points of fatigue failure and degrading cold forgeability. Al content range is therefore defined as 0.01 to 0.08%.

Cr: 0.7 to 1.5%

Cr is a useful element that is small in potential for boosting cold deformation resistance and capable of effectively imparting hardenability to the steel. At a Cr content of less than 0.7%, the hardenability imparted to components is inadequate, while addition of more than 1.5% degrades carburization performance. The range of Cr content is therefore set at 0.7 to 1.5%. The preferred range of addition is 0.9 to 1.5%.

B: 0.0005 to 0.005%

B is added with the following three aims: 1) in the rolling of bar steel and wire rod, to generate boron and iron carbides in the cooling process after rolling, thereby accelerating ferrite growth to increase the ferrite fraction, 2) to utilize solute B for imparting hardenability to the steel while causing substantially no rise in deformation resistance, and 3) to utilize solute B to improve the grain boundary strength of the carburized steel, thereby enhancing the fatigue strength and impact strength of the carburized product. The aforesaid effects are insufficient when the amount of added B is less than 0.0005%. The effects saturate at a content exceeding 0.005%. The range of B addition is therefore stipulated as B: 0.0005 to 0.005%

Ti: 0.01 to 0.15%

Ti combines with N in the steel to form TiN, thus immobilizing solute N and preventing precipitation of BN. This makes it possible to maintain the level of added solute B, thereby enabling B to manifest its hardenability enhancing effect. The effect of Ti is insufficient when added to less than 0.01%. On the other hand, when Ti is added in excess of 0.15%, its contribution to precipitation hardening rises to cause loss of cold forgeability. Ti content is therefore defined as 0.01 to 0.15%.

N: 0.008% or less

As pointed out above, in order to maintain the required level of solute B, formation of BN must be avoided by adding Ti to turn solute N into TiN precipitate. However, a steel N content exceeding 0.008% causes increased precipitation of coarse TiN that causes cracking during cold forging and acts as starting points for fatigue fracture. N content is therefore controlled to 0.008% or less. Preferably it is controlled to within the range of 0.006% or less.

Mo: 0.005 to 0.3%

Mo addition has three main effects. The first is improvement of steel hardenability. The second is improvement of surface fatigue strength achieved by improving temper softening resistance against temperature rise during component use. The third is improvement of impact property achieve by strengthening the grain boundaries of the carburized steel. These effects cannot be sufficiently obtained at an Mo content of less than 0.005%. On the other hand, addition of more than 0.3% degrades cold forgeability by increasing deformation resistance at room temperature. The range of Mo addition is therefore defined as 0.005 to 0.3%.

Ni: 0.1 to 4.5%

Ni addition has two main effects. One is improvement of steel hardenability. The other is increase of steel toughness. These effects cannot be sufficiently obtained at an Ni content of less than 0.1%. On the other hand, addition of more than 4.5% degrades cold forgeability by increasing deformation resistance at room temperature. The range of Ni addition is therefore defined as 0.1 to 4.5%.

Next, explanation will be made regarding the primary technological feature of the present invention, namely, that 65% or more of the metallographic structure must be ferrite phase.

Steels of various compositions comprising elements selected within the ranges of C: 0.07% to 0.8%, Si: 0.01% to 0.15%, Mn: 0.1% to 0.7%, P: 0.03% or less, S: 0.005% to 0.10%, Al: 0.01% to 0.08%, Cr: 0.7% to 1.5%, Ti: 0.01% to 0.15%, B: 0.0005% to 0.005%, and N: 0.008% or less, and the balance of Fe and unavoidable impurities, were melted/hot rolled to produce 60 mm+bar steels. At this time, cooling temperature change from 800 to 500° C. after hot finish rolling was in the range of 0.1 to 1° C./sec.

Figure 5:
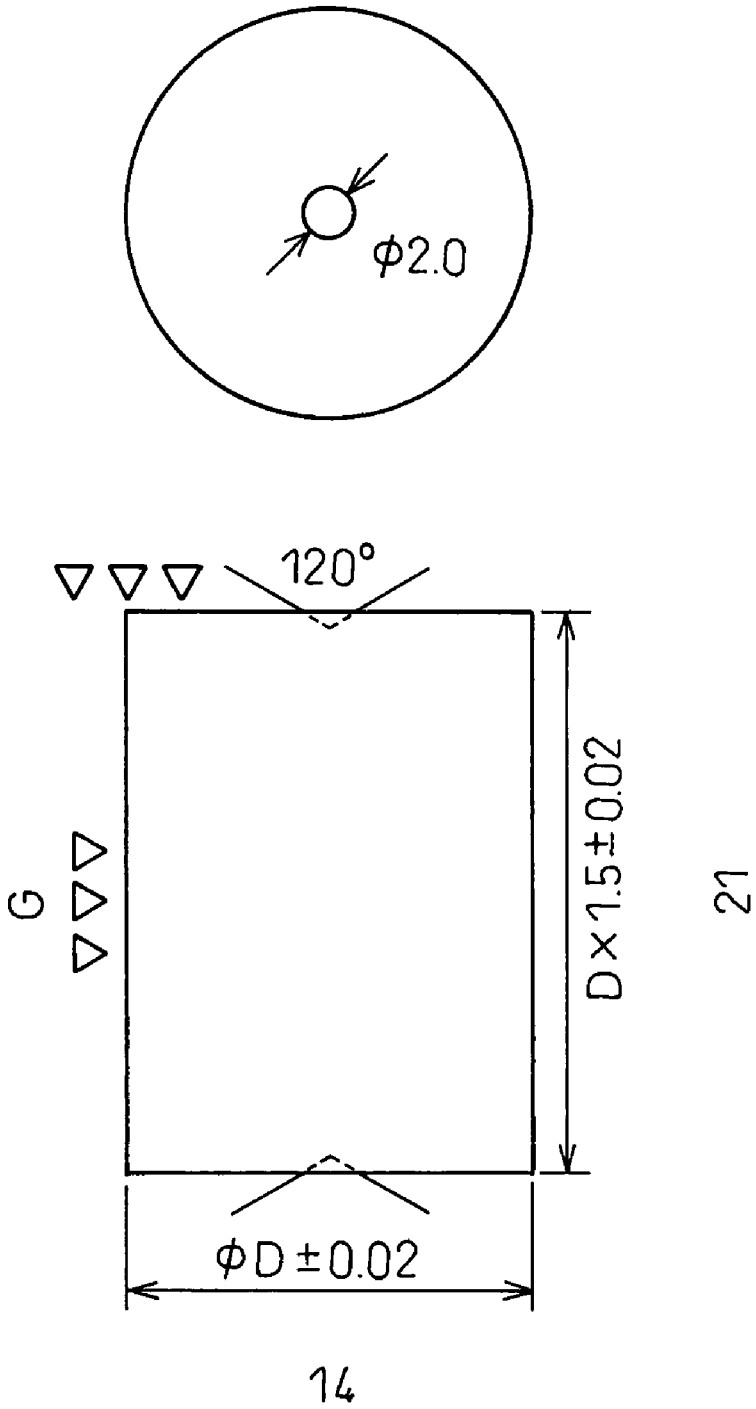
FIG. 5 shows the shape of a test piece for measuring room-temperature deformation resistance.
Figure 6:
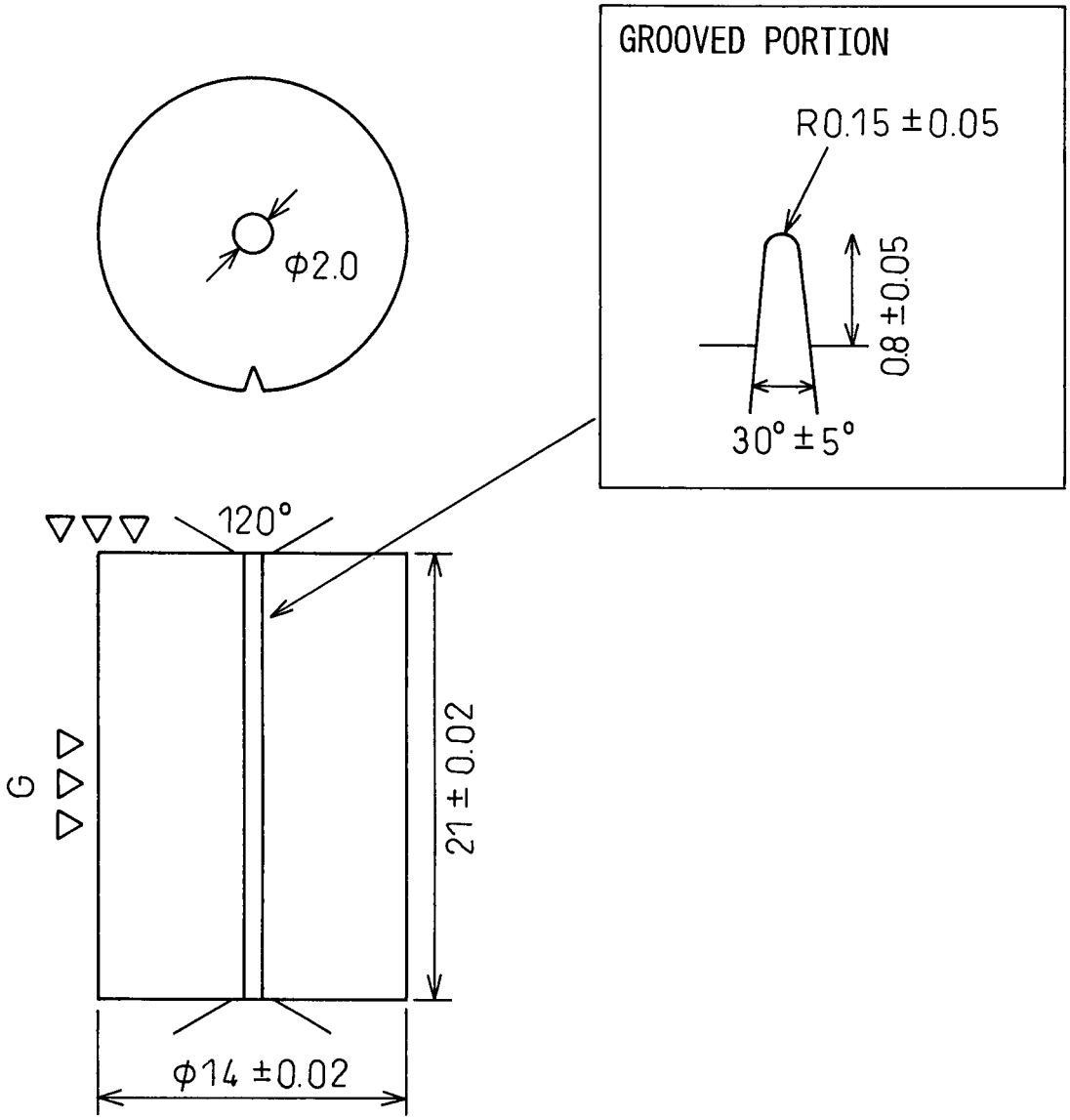
FIG. 6 shows the shape of a test piece for measuring limit compressibility.

Test specimens prepared from the bar steels to the size shown in FIG. 5 were measured for deformation resistance to determine stress at strain of 0.5. Further, test specimens prepared as shown FIG. 6 were used to measure limit compressibility at room temperature. In addition, the metallographic structure of a longitudinal section of the bar steel of each specimen was examined and measured for ferrite fraction. The HV hardness of each section was also measured. In addition, 55 mmϕ×15 mm thick disk specimens prepared from the bar steels were carburized at 950° C.×5 hr, quenched-tempered at 850° C., and measured for roundness. Roundness (departure from roundness) was measured in accordance with JIS B0621-1984 using a commercially available roundness measuring instrument.

Figure 3:
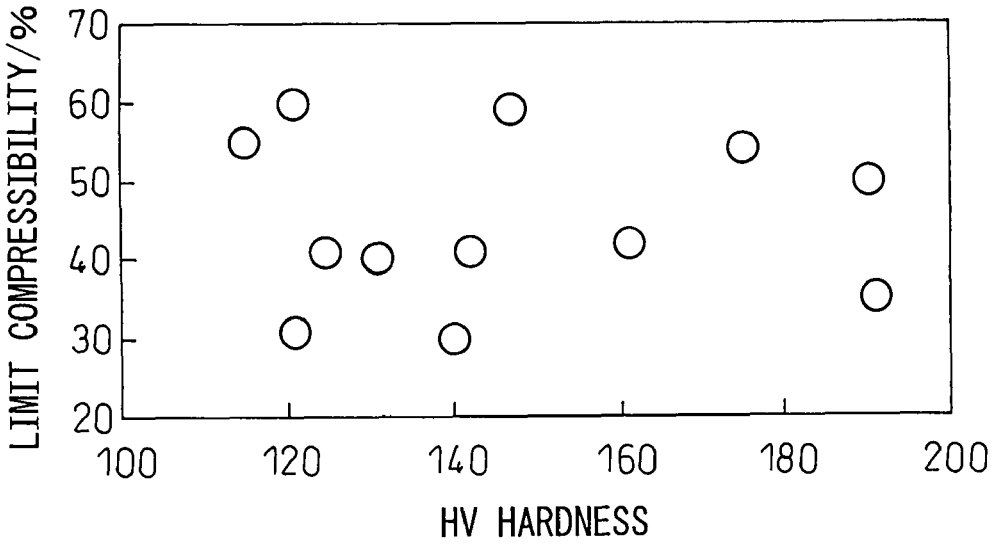
FIG. 3 is a chart showing how limit compressibility varies with rolled steel hardness.
Figure 4:
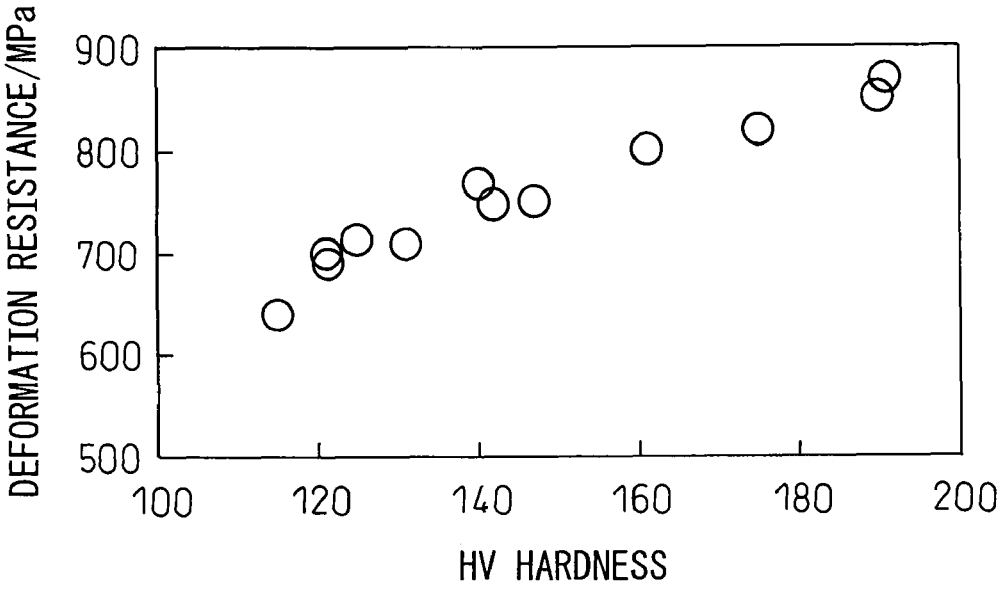
FIG. 4 is a chart showing how deformation resistance varies with rolled steel hardness.

As shown in FIG. 4, deformation resistance decreased with decreasing hardness but, as shown in FIG. 3, limit compressibility did not necessarily decrease when hardness was low. Nevertheless, as shown in FIG. 1, limit compressibility improved with increasing ferrite fraction and this tendency was evident at a ferrite fraction of 65% and greater.

Figure 2:
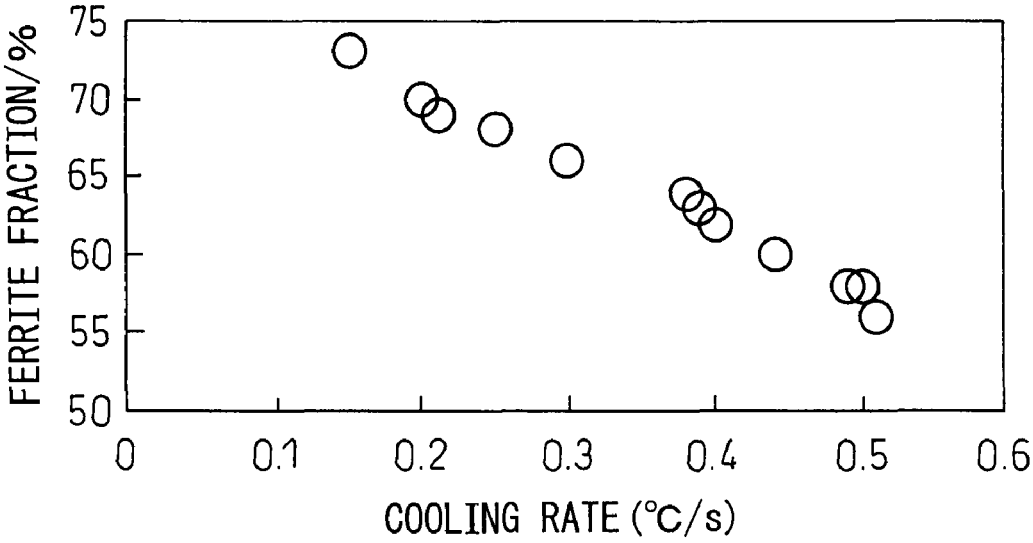
FIG. 2 is a chart showing how ferrite fraction varies with cooling rate after finish rolling.

From FIG. 2 it can be seen that a ferrite fraction of 65% or greater could be achieved by making the cooling rate after hot finish rolling 0.3° C./sec or less. For achieving this slow cooling, the finish-rolled bar steel should not be left to cool while standing in the air after rolling but should be cooled by the method of, for example, covering the bar steel with a slow cooling cover equipped with a heat source.

The reason why limit compressibility improves with increasing ferrite fraction is believed to be as follows. When ferrite fraction increases, pearlite fraction decreases. Lamellar cementite in the pearlite is thought to act as cracking starting points during cold forging.

Figure 8:
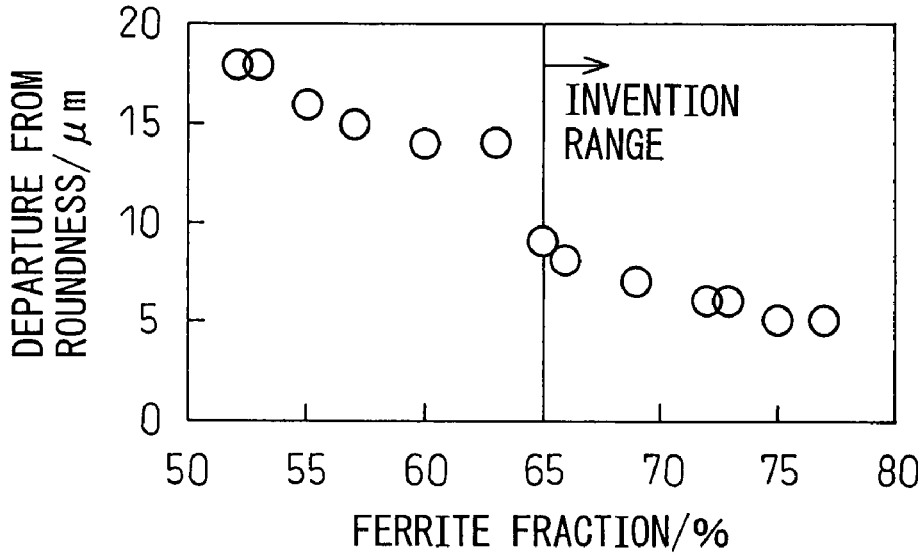
FIG. 8 is a chart showing how roundness varies with ferrite fraction.

FIG. 8 shows how roundness varies with ferrite fraction after carburization quenching. This phenomenon is presumed to arise as follows. Although pearlite fraction is low when ferrite fraction is high, the amount of C in pearlite increases in proportion, thereby making the lamellar cementite thick. As a result, it takes time for the thick cementite to dissolve completely during carburization heating and it therefore transforms to γ at a higher temperature. Since the dislocations that accumulate during cold forging recover and merge/vanish more readily as the temperature is higher, recrystallization is completed and granulation occurs before γ transformation. This granulation is believed to suppress grain enlargement.

The inventors newly discovered that increasing the ferrite fraction lowers distortion after carburization quenching. It can be seen from FIG. 8 that the effect of reducing distortion is large when ferrite fraction is 65% or greater.

The post-rolling ferrite fraction was defined as 65% or greater based on the results of the foregoing research.

The reason for making the bainite fraction 15% or less will now be explained.

Bainite structure present in the steel after hot rolling causes formation of large grains during carburation heating. As the generation of large grains might amplify the distortion after carburization quenching, the following experiment was conducted.

Figure 7:
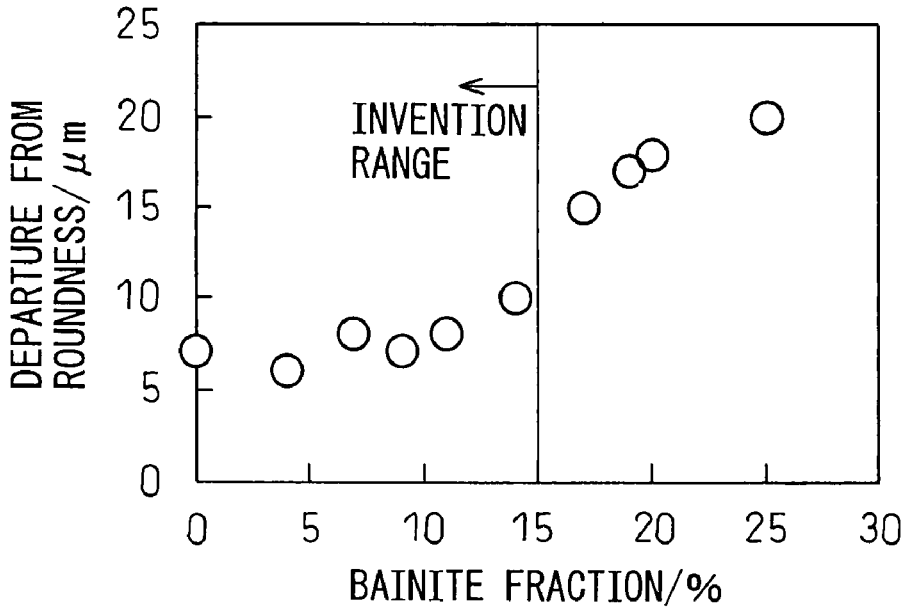
FIG. 7 is a chart showing how roundness varies with bainite fraction.

Steels of various compositions comprising elements selected within the ranges of C: 0.07% to 0.8%, Si: 0.01% to 0.15%, Mn: 0.1% to 0.7%, P: 0.03% or less, S: 0.005% to 0.10%, Al: 0.01% to 0.08%, Cr: 0.7% to 1.5%, Ti: 0.01% to 0.15%, B: 0.0005% to 0.005%, and N: 0.008% or less, and the balance of Fe and unavoidable impurities, were melted/hot rolled, and the cooling rate was varied through the temperature range of 800 to 500° C. after hot finish rolling at a rate in the range of 0.1 to 1° C./sec to produce 60 mmϕ bar steels. The metallographic structure of a longitudinal section of the bar steel of each specimen was examined and measured for bainite fraction. In addition, 56 mmϕ×15 mm thick disk specimens prepared from the bar steels were carburized at 950° C.×5 hr, quenched-tempered at 850° C., and measured for roundness. Roundness was measured in accordance with JIS B0621-1984 using a commercially available roundness measuring instrument. The results are shown in FIG. 7. It can be seen that roundness was markedly large (departure distortion from true roundness large). Bainite fraction is therefore made 15% or less. Suppression of bainite fraction is also desirable from the viewpoint of cold forging improvement.

The results of this experiment verify that bainite fraction can be made 15% or less by making the cooling rate after hot finish rolling 1° C./sec or less.

Although the invention steel is excellent in cold forging capability, it can of course also be hot forged and warm forged. It is thus a steel that can be used to manufacture components by combining these processes.

The present invention will now be explained in more detail, by way of examples which in no way are meant to limit the scope of the invention, it being understood that any modifications in design made in light of teachings set out heretofore or hereinafter shall be construed as falling within the technical scope of the present invention.

EXAMPLES

The steels set out in Table 1 were manufactured into 55ϕ bar steels by melting and hot rolling. In the manufacture, the cooling rate in the temperature range of 800 to 500° C. following hot finish rolling was varied among different levels. The metallographic structure in a longitudinal section of each hot-rolled bar steel was etched with nital and observed with a light microscope to measure the ferrite fraction and bainite fraction. Test pieces for measuring room-temperature deformation resistance prepared as shown in FIG. 5 were used to measure deformation resistance and determine stress at strain of 0.5 at room temperature. Further, test specimens for measuring limit compressibility prepared as shown FIG. 6 were used to measure limit compressibility at room temperature. In addition, 52 mmϕ×15 mm thick disk specimens prepared from the bar steels were carburized at 950° C.×5 hr, quenched-tempered at 850° C., and measured for roundness. Roundness was measured in accordance with JIS B0621-1984 using a commercially available roundness measuring instrument.

Specimen Nos. 1 to 9 are invention Examples and all had excellent low deformation resistance and excellent limit compressibility. Specimens Nos. 10 to 19 are Comparative Examples. Specimen No. 10 represents a case in which deformation resistance was high because Si content was at a high level exceeding the range of the present invention. Specimen No. 11 represents a case in which deformation resistance was high because Mn content was at a high level exceeding the range of the present invention. Specimen No. 12 represents a case in which deformation resistance was high because C content was at a high level exceeding the range of the present invention. Specimen No. 13 represents a case in which deformation resistance was high and limit compressibility was low because Ti content was at a high level exceeding the range of the present invention. Specimen No. 14 represents a case in which formation of coarse TiN lowered limit compressibility because N content was at a high level exceeding the range of the present invention. Specimen No. 15 represents a case in which the steel was a JIS SCr 420 case-hardening steel and was high in deformation resistance because its Si Mn, Ti, B and N contents were outside the invention ranges. Specimen No. 16 represents a case in which the steel was a JIS SCM 420 case-hardening steel and was high in deformation resistance because its Si Mn, Ti, B and N contents were outside the invention ranges. Specimen No. 17 represents a case in which the steel was a JIS SNCM 815 case-hardening steel and was high in deformation resistance because its Si Mn, Ti, B and N contents were outside the invention ranges. Specimen No. 18 had a composition within the invention range but had a ferrite fraction outside the invention range, so that even though it was low in deformation resistance, it was inferior in limit compressibility and post-carburization roundness. Specimen No. 19 had a composition within the invention range but since it had a ferrite fraction and a bainite fraction outside the invention ranges, it was inferior in deformation resistance, limit compressibility, and post-carburization roundness.

TABLE 1

| | Steel | C | Si | Mn | P | S | Cr | Mo | Ni | Al | B | Ti | N |
|---|---|---|---|---|---|---|---|---|---|---|---|---|---|
| | | Steel composition (mass %) | | | | | | | | | | | |
| Invention | A | 0.20 | 0.05 | 0.34 | 0.012 | 0.018 | 1.15 | — | — | 0.032 | 0.0017 | 0.022 | 0.0045 |
| | B | 0.25 | 0.04 | 0.12 | 0.009 | 0.006 | 1.00 | — | — | 0.029 | 0.0006 | 0.012 | 0.0022 |
| | C | 0.07 | 0.15 | 0.59 | 0.015 | 0.020 | 1.45 | — | — | 0.071 | 0.0030 | 0.028 | 0.0060 |
| | D | 0.18 | 0.06 | 0.33 | 0.013 | 0.015 | 1.30 | — | — | 0.040 | 0.0022 | 0.130 | 0.0053 |
| | E | 0.15 | 0.05 | 0.29 | 0.011 | 0.013 | 1.02 | — | — | 0.036 | 0.0019 | 0.029 | 0.0042 |
| | F | 0.17 | 0.03 | 0.39 | 0.008 | 0.022 | 1.23 | — | — | 0.035 | 0.0015 | 0.024 | 0.0044 |
| | G | 0.08 | 0.04 | 0.36 | 0.010 | 0.014 | 1.10 | 0.18 | — | 0.025 | 0.0011 | 0.024 | 0.0031 |
| | H | 0.07 | 0.01 | 0.35 | 0.011 | 0.014 | 1.45 | 0.20 | — | 0.035 | 0.0009 | 0.021 | 0.0046 |
| | I | 1.15 | 0.05 | 0.34 | 0.013 | 0.018 | 0.91 | 0.21 | 4.3 | 0.028 | 0.0014 | 0.026 | 0.0042 |
| Comparative | J | 0.21 | 0.25 | 0.32 | 0.014 | 0.019 | 1.16 | — | — | 0.025 | 0.0017 | 0.024 | 0.0033 |
| | K | 0.22 | 0.10 | 0.75 | 0.014 | 0.020 | 1.18 | — | — | 0.022 | 0.0012 | 0.026 | 0.0041 |
| | L | 0.34 | 0.08 | 0.41 | 0.012 | 0.017 | 1.09 | — | — | 0.019 | 0.0013 | 0.021 | 0.0047 |
| | M | 0.17 | 0.03 | 0.39 | 0.008 | 0.018 | 1.21 | — | — | 0.035 | 0.0015 | 0.170 | 0.0046 |
| | N | 0.17 | 0.03 | 0.39 | 0.008 | 0.018 | 1.21 | — | — | 0.035 | 0.0009 | 0.040 | 0.0110 |
| | O | 0.20 | 0.20 | 0.77 | 0.015 | 0.016 | 1.10 | — | — | 0.033 | — | — | 0.0120 |
| | P | 0.22 | 0.23 | 0.80 | 0.016 | 0.017 | 1.11 | 0.22 | — | 0.025 | — | — | 0.0110 |
| | Q | 0.16 | 0.26 | 0.55 | 0.017 | 0.014 | 0.85 | 0.21 | 4.3 | 0.027 | — | — | 0.0130 |
| | R | 0.20 | 0.05 | 0.36 | 0.012 | 0.018 | 1.15 | — | — | 0.032 | 0.0017 | 0.025 | 0.0039 |
| | S | 0.20 | 0.10 | 0.50 | 0.010 | 0.019 | 1.13 | 0.22 | — | 0.040 | 0.0016 | 0.024 | 0.0052 |

TABLE 2

| | Specimen No. | Steel | Post-finish rolling cooling rate (° C./s) | Ferrite fraction (%) | Bainite fraction (%) | Deformation resistance (MPa) | Limit Compressibility (%) | Post-carburization departure from roundness (μm) |
|---|---|---|---|---|---|---|---|---|
| Invention | 1 | A | 0.25 | 66 | 0 | 640 | 51 | 7 |
| | 2 | B | 0.25 | 65 | 0 | 650 | 52 | 7 |
| | 3 | C | 0.15 | 73 | 0 | 610 | 60 | 5 |
| | 4 | D | 0.20 | 69 | 0 | 630 | 59 | 7 |
| | 5 | E | 0.20 | 68 | 0 | 630 | 58 | 6 |
| | 6 | F | 0.25 | 66 | 0 | 630 | 51 | 7 |
| | 7 | G | 0.15 | 70 | 4 | 620 | 60 | 6 |
| | 8 | H | 0.20 | 71 | 4 | 620 | 60 | 6 |
| | 9 | I | 0.30 | 66 | 6 | 680 | 52 | 8 |
| Comparative | 10 | J | 0.25 | 66 | 0 | 700 | 48 | 8 |
| | 11 | K | 0.20 | 68 | 0 | 710 | 51 | 7 |
| | 12 | L | 0.20 | 68 | 0 | 720 | 50 | 7 |
| | 13 | M | 0.25 | 66 | 0 | 720 | 45 | 8 |
| | 14 | N | 0.25 | 66 | 0 | 650 | 45 | 7 |
| | 15 | O | 0.20 | 68 | 0 | 750 | 51 | 7 |
| | 16 | P | 0.20 | 67 | 3 | 780 | 50 | 8 |
| | 17 | Q | 0.25 | 66 | 6 | 800 | 49 | 8 |
| | 18 | R | 0.40 | 61 | 0 | 640 | 41 | 14 |
| | 19 | S | 1.20 | 55 | 17 | 790 | 38 | 18 |

The invention claimed is:

1. A case-hardening steel excellent in cold forgeability and low carburization distortion property used in cold forged large components and complexly shaped components consisting of, in mass %, C: 0.07% to 0.3%, Si: 0.01% to 0.15%, Mn: 0.1% to 0.7%, P: 0.03% or less, S: 0.002% to 0.10%, Al: 0.01% to 0.08%, Cr: 0.7% to 1.5%, Ti: 0.01% to 0.029%, B: 0.0005% to 0.005%, N: 0.008% or less, and the balance of Fe and unavoidable impurities, and having a metallographic structure comprising 65% or greater of ferrite and 15% or less of bainite by means of a cooling rate of 0.3° C./sec or less, and having cold deformation resistance of 650 MPa or less.

2. The case-hardening steel of claim 1, wherein the steel does not include Mo.

3. A case-hardening steel excellent in cold forgeability and low carburization distortion property used in cold forged large components and complexly shaped components consisting of, in mass %, C: 0.07% to 0.3%, Si: 0.01% to 0.15%, Mn: 0.1% to 0.7%,
P: 0.03% or less,
S: 0.002% to 0.10%,
Al: 0.01% to 0.08%,
Cr: 0.7% to 1.5%,
Ti: 0.01% to 0.029%,
B: 0.0005% to 0.005%,
N: 0.008% or less, and
the balance of Fe and unavoidable impurities, wherein the steel does not include Mo, and having a metallographic structure comprising 65% or greater of ferrite and 15% or less of bainite and having cold deformation resistance of 650 MPa or less.

4. The case-hardening steel of claim 1 or claim 3, wherein Ti: 0.01% to 0.026.

5. The case-hardening steel of claim 1 or claim 3, wherein the limit compressibility is 51% or greater.

6. The case-hardening steel of claim 1 or claim 3, wherein the case-hardening steel is selected from a cold forged large component and a complexly shaped component.

7. The case-hardening steel of claim 5, wherein the steel is a helical gear.

* * * * *